US011279896B2

(12) United States Patent
Amblard et al.

(10) Patent No.: US 11,279,896 B2
(45) Date of Patent: Mar. 22, 2022

(54) GEAR LUBRICANT COMPOSITION

(71) Applicant: TOTAL MARKETING SERVICES, Puteaux (FR)

(72) Inventors: Bénédicte Amblard, Lyons (FR); Florence Bredon, Oullins (FR); Frédéric Espinoux, Charly (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/492,698

(22) PCT Filed: Mar. 12, 2018

(86) PCT No.: PCT/EP2018/056095
§ 371 (c)(1),
(2) Date: Sep. 10, 2019

(87) PCT Pub. No.: WO2018/162761
PCT Pub. Date: Sep. 13, 2018

(65) Prior Publication Data

US 2020/0048572 A1 Feb. 13, 2020

(30) Foreign Application Priority Data

Mar. 10, 2017 (FR) ..... 1751957

(51) Int. Cl.

| | |
|---|---|
| ***C10M 105/32*** | (2006.01) |
| ***C10M 169/04*** | (2006.01) |
| *C10N 30/06* | (2006.01) |
| *C10N 30/00* | (2006.01) |
| *C10N 40/04* | (2006.01) |

(52) U.S. Cl.
CPC ..... *C10M 105/32* (2013.01); *C10M 169/04* (2013.01); *C10M 2207/2805* (2013.01); *C10M 2223/043* (2013.01); *C10M 2223/047* (2013.01); *C10M 2229/02* (2013.01); *C10N 2030/06* (2013.01); *C10N 2030/36* (2020.05); *C10N 2030/64* (2020.05); *C10N 2040/04* (2013.01)

(58) Field of Classification Search
CPC .... C10M 2207/2805; C10M 2223/043; C10M 2223/047; C10M 2229/02; C10N 2240/04; C10N 2040/04; C10N 2030/06
See application file for complete search history.

(56) References Cited

U.S. PATENT DOCUMENTS

| | | | | |
|---|---|---|---|---|
| 5,022,492 | A | 6/1991 | Ohno et al. | |
| 6,361,711 | B1 | 3/2002 | Abe et al. | |
| 7,666,822 | B2 | 2/2010 | Imai et al. | |
| 8,987,177 | B2 | 3/2015 | Okada et al. | |
| 2004/0235679 | A1 | 11/2004 | Kurosky et al. | |
| 2006/0217275 | A1 | 9/2006 | Imai et al. | |
| 2009/0176670 | A1* | 7/2009 | Kawasaki | C10M 129/10 508/177 |
| 2012/0053098 | A1 | 3/2012 | Okada et al. | |
| 2014/0155307 | A1 | 6/2014 | Kawasaki | |
| 2014/0162918 | A1 | 6/2014 | Fu et al. | |
| 2014/0296117 | A1* | 10/2014 | Ohno | C10M 105/42 508/439 |
| 2016/0340602 | A1* | 11/2016 | Erdemir | C10M 169/04 |

FOREIGN PATENT DOCUMENTS

| | | |
|---|---|---|
| JP | 1979064264 | 5/1979 |
| JP | 1988125598 | 5/1988 |
| JP | 1995150161 | 6/1995 |
| JP | 2011063734 | 3/2011 |
| WO | WO-2017217299 | 12/2017 |

OTHER PUBLICATIONS

International Search Report dated Apr. 27, 2018 in In Application No. PCT/EP2018/056095.
French Search Report dated Jul. 14, 2017 in corresponc Application No. 1751957.
Anonymous: "Priolube 3999", CRODA Lubricants, 2 011, XP002 Retrieved from the Internet: URL: https://www.crodalubricants.com/en-gb/technical-library/datasheets-and-msds, retrieved on Jul. 14, 2017.

* cited by examiner

*Primary Examiner* — Vishal V Vasisth
(74) *Attorney, Agent, or Firm* — B. Aaron Schulman, Esq.; Stites & Harbison, PLLC

(57) ABSTRACT

The present application relates to a gear lubricant composition comprising: 97 to 99.9 wt.-% trimethylolpropane triester; and 0.1 to 3 wt.-% at least one additive selected from among anti-wear additives, extreme pressure additives, antioxidants, anti-corrosion additives, metal deactivator additives, antifoams, and mixtures thereof.

5 Claims, No Drawings

GEAR LUBRICANT COMPOSITION

This application is a 371 of PCT/EP2018/056095, filed Mar. 12, 2018.

The present invention relates to gear lubricant compositions. Said compositions according to the invention are biodegradable, do not bioaccumulate in organisms and do not represent toxicity to the environment, especially the aquatic environment.

Since December 2013, US regulations have been amended to require all vessels operating in US waters to use Environmentally Acceptable Lubricant (EAL) products, and since 1992 in Europe, an Ecolabel has been used to identify products that respect the environment in the field of lubricants. The components of these products may be derived from the LuSC list (Lubricant Substance Classification) and meet, in particular, the strict requirements of biodegradability, bioaccumulation and aquatic toxicity. Ecolabel lubricants are considered to be lubricants that meet the environmental specifications of EAL lubricants.

These Ecolabel or EAL lubricants are used in equipment that may have interfaces and/or contacts with a user, with air and/or with water. This applies, in particular, to gear lubricant compositions which may be in direct contact with water and/or air and/or with humans and/or any other contact requiring biodegradable non-toxic products.

In addition, gear lubricant compositions for industrial or marine use must meet very specific performance specifications, particularly in terms of tribological performance and seal compatibility.

There is therefore an interest in providing biodegradable lubricant compositions, not exhibiting bioaccumulation in organisms, exhibiting no toxicity for the environment, more particularly the aquatic environment, and satisfying to all the specific tests for gear lubricant compositions.

An object of the present invention is to provide a lubricant composition, in particular for gearing, which is biodegradable, does not exhibit bioaccumulation in organisms and exhibits no toxicity to the environment, more particularly the aquatic environment.

Another object of the present invention is to provide a composition which provides the specific properties relating to gear compositions, particularly in terms of the tribological properties and seal compatibility. Other objects will become apparent upon reading the description of the invention which follows.

The present application relates to a gear lubricant composition comprising:

- 97 to 99.9% by weight of a trimethylolpropane triester; and
- 0.1 to 3% by weight of at least one additive chosen from among anti-wear additives, extreme pressure additives, antioxidants, anticorrosion additives, metal deactivator additives, defoamers, and their mixtures.

In the context of the present invention, the term "lubricant composition" is understood to mean a lubricant composition that meets the criteria of European Parliament and Council Regulation No. 66/2010 of 25 Nov. 2009. This regulation made it possible to establish the Ecolabel of the European Union. The certification framework of the Ecological label of the European Union for Lubricants (identification number EC 511 revision 4 of 4 Jul. 2016) details the criteria for lubricants. Substances and mixtures subject to a limitation or exclusion are defined in this standard. The additional requirements for aquatic toxicity are specified (OECD 201 methods for algae, OECD 202 for daphnids, OECD 203 for fish). The biodegradability and bioaccumulation potential criteria are defined in this same reference document.

Preferably, the trimethylolpropane triester is a linear or branched C14-C20 saturated or unsaturated fatty acid triester, preferably C16-C20, for example C18. More preferably, the trimethylolpropane triester is a branched C14-C20 saturated fatty acid ester, preferably C16-C20, for example C18. Advantageously, the trimethylolpropane triester is trimethylolpropane iso-stearate.

The additives that may be used in the compositions according to the invention are LuSC-list additives or additives that make it possible to obtain a biodegradable formula that meets the Ecolabel standard or the American EAL specifications.

Anti-wear additives and extreme pressure additives protect the friction surfaces by forming a protective film adsorbed on these surfaces. There is a wide variety of anti-wear additives. In a preferred manner, certain additives are both anti-wear and extreme pressure additives.

In a preferred manner for the lubricant composition according to the invention, the anti-wear and extreme pressure additives are chosen from among phosphorus-free or phosulfur-free ashless additives such as, for example, phosphates, phosphorothionates, phosphonates, dithiophosphates and thio phosphates such as dialkyl dithiophosphates.

As an anti-wear additive, mention may also be made of triaryl thiophosphate, carbamates and thiocarbamates.

Also preferably, certain additives may be simultaneously anti-wear, extreme pressure and anti-corrosion additives. Among these additives, mention may be made of amine phosphates which may be used in the lubricant composition according to the invention.

Advantageously, the lubricant composition according to the invention may comprise at least one anti-corrosion additive such as an N-acyl sarcosine compound.

Advantageously, the lubricant composition according to the invention may comprise at least one metal-deactivating additive such as a tolutriazole or di-mercapto thiadiazole derivative.

Advantageously, the lubricant composition according to the invention may comprise at least one anti-foam additive such as a silicone compound or a polyacrylate compound.

Advantageously, the lubricant composition according to the invention may comprise at least one antioxidant additive.

The antioxidant additive generally serves to retard the degradation of the lubricant composition in service. Antioxidant additives act, in particular, as radical inhibitors or destroyers of hydro peroxides. Among antioxidant additives commonly used, mention may be made of antioxidant additives of the phenolic type, antioxidant additives of the amine type.

The phenolic antioxidant additives may, in particular, be chosen from among sterically-hindered phenols, sterically-hindered phenol esters and sterically-hindered phenols comprising a thioether bridge. Preferably, according to the invention, the sterically-hindered phenols are chosen from among compounds comprising a phenol group in which at least one vicinal carbon of the carbon bearing the alcohol function is substituted by at least one C1-C10 alkyl group, preferably a C1-C6 alkyl group, preferably a C4 alkyl group, preferably by the ter-butyl group.

The antioxidant amine additives may be chosen from diphenylamines, diphenylamines substituted with at least one C1-C12 alkyl group, N,N'-dialkyl-aryl-diamines, octylphenyl naphthylamine and mixtures thereof.

Examples of amine compounds are aromatic amines, for example aromatic amines of formula $NR^4R^5R^6$ in which $R^4$ represents an optionally substituted aliphatic or aromatic group, $R^5$ represents an optionally substituted aromatic group, $R^6$ represents a hydrogen atom, an alkyl group, an aryl group.

Antioxidant amine additives may be used in combination with phenolic antioxidant additives.

Preferably, the composition of the invention comprises as additives:

0.1 to 1% by weight of an anti-wear additive of the amine phosphate type; and 0.1 to 1% by weight of a phenolic antioxidant additive.

Preferably the amine phosphate is selected from amine alkyl phosphate.

Preferably, the phenolic antioxidant is preferably chosen from among sterically-hindered phenols, chosen among compounds comprising a phenol group in which at least one vicinal carbon of the carbon carrying the alcohol function is substituted by at least one C1-C10 alkyl group, preferably a C1-C6 alkyl group, preferably a C4 alkyl group, preferably by the ter-butyl group. Preferably, the phenol is chosen from among phenolic compounds in which the two vicinal carbons of the carbon carrying the alcohol function are substituted by at least one C1-C10 alkyl group, preferably a C1-C6 alkyl group, preferably a C4 alkyl group, preferably by the ter-butyl group, while another carbon is substituted by an alkyl ester group.

Particularly advantageously, the composition according to the invention is biodegradable, does not exhibit bioaccumulation in organisms and does not present any toxicity for the environment, more particularly the aquatic environment, and meets the European Ecolabel and the American EAL specifications. Furthermore, the composition according to the invention meets the various characteristic tests of gear lubricant compositions.

The present invention also relates to the use of the lubricant composition according to the invention for gear lubrication, in particular in the marine field, and in equipment having gearing that may be in contact with the environment (water, air, etc,) or humans.

The composition according to the invention is also useful for the lubrication of equipment comprising gears, in particular for the lubrication of the stern tube.

The stern tube is the system for passing through the hull to the propeller shaft while maintaining maximum sealing.

The present invention also relates to a method for lubricating gears implementing the lubricant composition according to the invention, i.e. comprising the lubrication of the parts in contact with a lubricant composition according to the invention.

The present invention also relates to a method for lubricating equipment comprising gears, in particular the stern tube, comprising the implementation of a lubricant composition according to the invention, i.e. the lubrication of the internal walls of the equipment comprising gears, in particular the inner walls of the stern tube, with a lubricant composition according to the invention.

The present invention will now be described with the aid of the following non-limiting examples.

EXAMPLE 1: EXAMPLE OF COMPOSITION ACCORDING TO THE INVENTION

Table 1 describes an example of composition according to the invention

TABLE 1

| Components | Composition 1, % m/m content |
|---|---|
| Trimethylolpropane iso-stearate | 98.52 |
| Phenolic antioxidant | 0.5 |
| Anti-wear amine phosphate | 0.5 |
| Anti-wear dialkyl dithiophoshate type | 0.09 |
| Anti-corrosion | 0.1 |
| Metal deactivator | 0.09 |
| Antifoam silicone stock solution | 0.2 |

EXAMPLE 2: TRIBOLOGICAL TRIALS

The following tribological tests were carried out:

FZG A/8.3/90° C. according to ISO 14635-1 (equivalent to CEC L-07-A-95)

FZGA/8.3/60° C. according to the modified ISO 14635-1 standard

FZG A10/16.6R/30 according to ISO 14635-2 (equivalent to CEC L-84)

FZG A10/16.6R/90 according to ISO 14635-2 (equivalent to CEC L-84).

Micropitting C-GF/8.3/90 according to FVA 54/I-IV

FAG-FE8 D7,5/80-80 according to DIN51819-3

FAG-FE8 D7,5/100-80 according to DIN51819-3

The results are shown in Table 2 below. A + means that the composition passes the conventional test implemented to determine the wear or seizure gears. A – means that the composition does not pass this test.

TABLE 2

| | Measured parameter | Performance to be achieved | Composition 1 |
|---|---|---|---|
| FZG A/8.3/90° C. | Seizing of the damaged bearing | >12 | >14 |
| FZG A/8.3/60° C. | Seizing of the damaged bearing | | + |
| FZG A10/16.6R/30 | Seizing of the damaged bearing | | + |
| FZG A10/16.6R/90 | Seizing of the damaged bearing | delay | 9 |
| Micropitting C-GF/8.3/90 according to FVA 54/I-IV | Gear wear | Minimum 10 | Greater than 10 |
| FAG-FE8 D7.5/80-80 | Rolling element wear | Maximum 20 mg | 4 mg |
| FAG-FE8 D7.5/100-80 | Rolling element wear | | + |
| FZG slow speed wear test at 40-60° C., DGMK 377-01 method (C/0.05/90:120/12) | Gear wear | | + |

These tests indicate that the composition according to the invention passes the tests used to measure wear and seizure in the gearing, i.e. the composition according to the invention implemented in gearing achieves minimum wear and seizure of the constituent elements of the gearing.

EXAMPLE 3: SEAL COMPATIBILITY

Seal tests were conducted in two ways:

FKM-2-168 h/130° C. and 168 h/175° C.,

Freudenberg tests according to the method described in document FB 73 11 008 "Static and dynamic oil compatibility tests for Freudenberg radial shafts seals to release the usage in Flender-gear units applications (Table T 7300)", Ed. 2013.

TABLE 3

| | Acceptable limits in % | Composition 1 |
|---|---|---|
| Seal tests - FKM-2 - 168 h/130° C. | | |
| Volume variation | Less than 7/8 | 0.3 |
| Hardness variation | delay | 0.3 |
| Breaking load variation | Less than 25 | −0.7 |
| Elongation breaking variation | Less than 25 | 5.4 |
| Seal tests - FKM-2 - 168 h/175° C. | | |
| Volume variation | Less than 7/8 | −1.2 |
| Hardness variation | delay | 1.05 |
| Breaking load variation | Less than 25 | −7.8 |
| Elongation breaking variation | Less than 25 | −2.5 |

Nd: Not Determined

| Freudenberg tests | Acceptable limits in % | Composition 1 |
|---|---|---|
| Elastomer FKM 585 130° C./1000 h | | |
| Volume variation (%) | −2/+5 | 2.1 |
| Hardness variation | −5/+5 | −1.2 |
| Breaking load variation (%) | −50/+20 | 12.9 |
| Elongation breaking variation (%) | −60/+20 | −13.9 |
| Elastomer NBR 902 95° C./1000 h | | |
| Volume variation (%) | −2/+5 | 1.8 |
| Hardness variation | −5/+5 | −3.3 |
| Breaking load variation (%) | −50/+20 | −11.1 |
| Elongation breaking variation (%) | −60/+20 | −21.1 |
| Elastomer FKM 260466 | | |

-continued

| Freudenberg tests | Acceptable limits in % | Composition 1 |
|---|---|---|
| 130° C./1000 h | | |
| Volume variation (%) | −2/+5 | 0.9 |
| Hardness variation | −5/+5 | −1 |
| Breaking load variation (%) | −50/+20 | 9.5 |
| Elongation breaking variation (%) | −60/+20 | 5 |

These results show that the lubricant composition according to the invention is compatible with the various seals studied and does not deteriorate the properties of the seals.

The invention claimed is:

1. A method of lubricating gearing or equipment comprising gearing comprising lubricating the parts of said gearing or equipment comprising gearing by placing the parts in contact with a lubricant composition consisting essentially of:

97 to 99.9% by weight of a trimethylolpropane triester, wherein the trimethylolpropane triester is a branched C14-C20 saturated fatty acid ester; and 0.1 to 3% by weight of at least one additive selected from the group consisting of anti-wear additives, extreme pressure additives, antioxidants, anticorrosive additives, metal deactivator additives, defoamers, and mixtures thereof;

wherein the trimethylolpropane triester is trimethylolpropane isostearate.

2. The method according to claim 1, wherein the composition comprises:

0.1 to 1% by weight of an anti-wear additive phosphate of amine; and 0.1 to 1% by weight of a phenolic antioxidant additive.

3. The method according to claim 2 wherein the amine phosphate is an amine alkyl phosphate.

4. The method according to claim 1, wherein the equipment comprising gearing is a stern tube.

5. A method of lubricating gearing or equipment comprising gearing comprising lubricating the parts of said gearing or equipment comprising gearing by placing the parts in contact with a lubricant composition comprising:

97 to 99.9% by weight of a trimethylolpropane isostearate; and 0.1 to 3% by weight of at least one additive selected from the group consisting of anti-wear additives, extreme pressure additives, antioxidants, anticorrosive additives, metal deactivator additives, defoamers, and mixtures thereof;

wherein the lubricant composition does not contain any unbranched or unsaturated fatty acid esters.

* * * * *